United States Patent [19]

Buchl

[11] Patent Number: 4,841,923

[45] Date of Patent: Jun. 27, 1989

[54] METHOD FOR OPERATING I.C. ENGINE INLET VALVES

[76] Inventor: Josef Buchl, Rehsteig 12, Lenting 8071, Fed. Rep. of Germany

[21] Appl. No.: 165,484

[22] Filed: Mar. 8, 1988

[30] Foreign Application Priority Data

Mar. 14, 1987 [DE] Fed. Rep. of Germany ..... 3708373

[51] Int. Cl.[4] ..... F01L 9/04

[52] U.S. Cl. ..... 123/90.11; 251/129.1

[58] Field of Search ..... 123/90.11; 251/65, 129.09, 251/129.10, 337

[56] References Cited

U.S. PATENT DOCUMENTS

| | | | |
|---|---|---|---|
| 4,544,986 | 10/1985 | Buchl | 123/90.11 X |
| 4,614,170 | 9/1986 | Pischinger et al. | 251/129.1 X |
| 4,700,684 | 10/1987 | Pischinger et al. | 123/90.11 X |
| 4,749,167 | 6/1988 | Gottschall | 251/129.1 X |

FOREIGN PATENT DOCUMENTS

| | | | |
|---|---|---|---|
| 3500530 | 7/1986 | Fed. Rep. of Germany | 123/90.11 |

*Primary Examiner*—Willis R. Wolfe

*Attorney, Agent, or Firm*—The Dulin Law Firm

[57] ABSTRACT

Methods for operating an inlet valve for internal combustion engines to improve fuel efficiency and reduce pollution, more particularly for operating electromagnetically operated inlet valves for optimum fuel-air mixture filling at low loads (up to about 20–25% of full throttle) by not holding the gas exchange (inlet) valve in the open position, but by re-attracting it immediately after its release from the closed position by the electromagnet allocated to the closed position. In a principal embodiment, this is achieved by de-energizing the closed position electromagnet but not thereafter energizing the open position electromagnet, then letting the anchor plate rebound from the spring compression on the open valve side of the anchor plate, and re-energizing the closed position electromagnet. Optimum mixing of the fuel-air mixture is achieved by timing the de-energization of the closed valve electromagnet at or slightly after bottom dead center (BDC) when the maximum pressure differential between inlet tube and cylinder interior occurs. This promotes greater utilization of the fuel energy content through better burning characteristics. Fuel consumption is reduced approximately 20%, and the exhaust gases, CO and $NO_x$ are reduced.

19 Claims, 1 Drawing Sheet

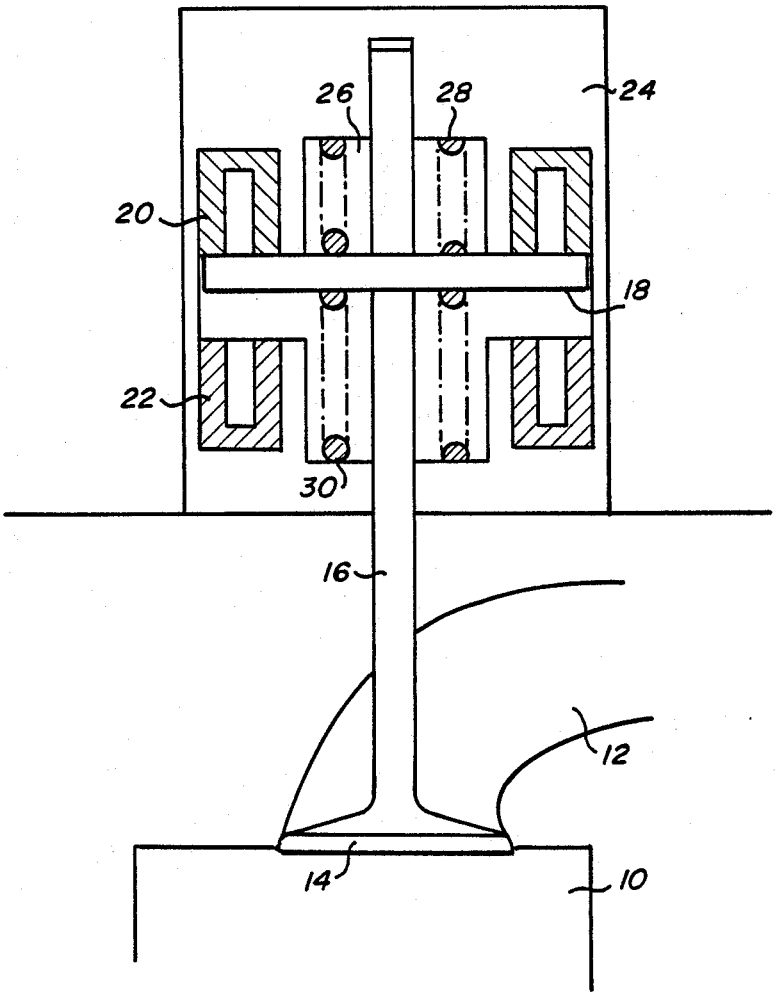
26
28
24
20
18
22
30
16
12
14
10

METHOD FOR OPERATING I.C. ENGINE INLET VALVES

FIELD

The invention relates to methods for operating an inlet valve for internal combustion engines to increase fuel efficiency and reduce pollution, more particularly for operating electromagnetically operated inlet valves for optimum fuel-air mixture filling at low loads (e.g., up to about 20–25% of full throttle) by not holding the gas exchange (inlet) valve in the open position, but by re-attracting it immediately after its release from the closed position by the electromagnet allocated to the closed position. In a principal embodiment this is achieved by de-energizing the closed position electromagnet but not thereafter energizing the open position electromagnet, then letting the anchor plate rebound from the spring compression on the open valve side of the anchor plate, and re-energizing the closed position electromagnet.

BACKGROUND

Low engine load conditions, e.g. engine start-up and idle at traffic lights or other vehicle waiting periods, are the periods of greatest fuel and combustion inefficiency, and produce relatively more CO, $NO_x$ and exhaust gases for the fuel used.

I.C. engines having one or more gas-exchange valves operated by excitation (energization) or de-energization of electromagnets, are known in the art. Examples are found in West German Patent Disclosure DE No. 30-24-109 (corresponding to U.S. Pat. No. 4,455,543 of Pischinger et al), and East German Patent Disclosure DE No. 35-00-530 (of Hauer et al., Binder Magnete GmbH). By switching an electromagnet off, an anchor plate connected to the gas exchange valve is released by the electromagnet and is moved away from the magnet core by spring force. In the mid-position between opposed electromagnets, the anchor plate is stressed (acted on) by springs on both sides. The anchor plate continues to move due to the initial spring push and the momentum obtained, until it moves near the opposing electromagnet, where an appropriate control energizes the open position electromagnet, ensuring that the anchor plate is captured and retained in the valve-open position. For closing, the same process is performed in reverse order.

The state-of-the-art methods require that the gas-exchange valve is held for defined periods of time in its open and closed positions, and the valve leaves its closed position only as the result of an appropriate control pulse to the electromagnet, e.g., de-energization of the closed position electromagnet.

In addition, in the state-of-the-art standard camshaft (pushrod) engines, at the phase when the inlet valve opens, the angular position of the camshaft is the same regardless of load and the timing of opening begins even before top dead center (TDC). The valve remains open through the entire downward motion of the piston, the so-called intake stroke. The inlet valve is closed about 35 degrees to 90 degrees after TDC. The quantity of gas filling the cylinder in this manner is controlled by the position of the throttle flap. By the nature of an engine in which valves are controlled by cams, the valve opening time cannot be varied in response to varying loads, RPM, etc. Designing the cam for best operation including early valve opening time at high loads means there is low efficiency at low loads.

The state-of-the-art I.C. engines having electromagnet-controlled gas-exchange valves can be operated in principle without the throttle flap. But the difficulty is that the spring system must be of very rigid (stiff) design to provide rapid response characteristics of releasing the anchor plate from the magnet. But it is not possible to make the springs relatively stiff enough (a cam and pushrod being "infinitely" stiff) so that at idle or low load requirements, the opening times of the inlet valve are sufficiently short to allow only small fuel-air mixtures to enter. Indeed, providing stiffer springs can increase the need for larger magnets to cancel the spring force when the anchor plates are captured and held. Yet larger magnets have greater delay in anchor plate release requiring even stiffer springs to obtain the necessary rapid response. This vicious circle, and the limited space available, puts natural limits on electromagnet control of valve operation during all phases of engine operation especially at low load conditions.

Accordingly, there is a great need in the art to provide better control of valves to improve fuel efficiency and reduce pollution at low load conditions.

THE INVENTION

OBJECTS

It is among the objects of the invention to provide a method for inlet of only small quantities of fuel-air mixture into cylinders of I.C. engines during low load conditions.

It is another object to provide a method for controlling the opening of electromagnetically actuated inlet valves in I.C. engines during low load conditions.

It is another object to provide a method of providing improved fuel efficiency and reduced CO, $NO_x$ and exhaust gases in I.C. engines during low load conditions by control of timing of inlet valve opening and duration through selective deenergization and energization of valve electromagnets.

Still other objects will be evident from the summary, drawing and detailed specification which follows.

THE DRAWING

The FIGURE shows schematically an electromagnetically controlled gas exchange valve of a type which can be operated in accord with the method of the present invention.

SUMMARY

The method of this invention provides for the gas-exchange valve being opened briefly by means of switching off the appropriate closed position electromagnet which releases the anchor plate. Due to the spring action the anchor plate is accelerated in the direction of the opening position. But unlike the present state-of-the-art technology, the gas-exchange valve anchor plate is not captured by the open position electromagnet. Rather, the capture mechanism (electromagnet) of the opening position is not activated.

For example, applying the method of this invention to a device of the type described in German Patent Disclosure 35-00-530, the electromagnet allocated to the opening position is activated, so that the gas-exchange valve is repelled from the open position, rather than being captured and held stationary in the open position. Control of the process can even be enhanced by an appropriate switching of the electromagnets.

Likewise, applying the process of this invention to the device of German Patent Disclosure 30-24-109, the electromagnet allocated to the opening position is not excited, so that the anchor plate moving into the attraction-region of the open position electromagnet is not attracted and held by it. Rather, the anchor plate rebounds by means of the spring loading in the opposite direction toward the closed position electromagnet. This repeatedly excited closing magnet, with pauses between successive excitations, ensures that the gas-exchange valve is opened only briefly during low load conditions. At higher loads the regular cycle of excitation of all electromagnets takes over.

A particularly favorable time for the appropriate release of the gas-exchange valve from closed position is the time shortly after bottom dead center (BDC), when a maximum underpressure prevails in the interior of the cylinder, and the piston is just beginning to move upward. Under these conditions, an optimum swirling of the mixture is achieved within the cylinder, which has a positive effect on the subsequent combustion process. The fuel consumption of an engine can be greatly reduced in this manner, e.g., on the order of 20%.

That timepoint can be utilized only if the method of this invention is used. This is because in spite of the severe pressure difference between the intake tube and the cylinder interior, only a small quantity of fuel-air mixture can enter due to the very brief opening times created by the "non-capture at open position" and BDC timing methods of this invention. The engine types described in the state-of-the-art cannot utilize the BDC timing since with their control methods (e.g., anchor capture or cam operated valve opening), opening at BDC allows too much fuel-air mixture to enter the cylinder interior. Accordingly, such engines would have to have the intake valve opening moved to an earlier time, namely into the range between TDC and BDC of the intake stroke to reduce the amount of fuel-air mixture entering the cylinder because of lower pressure differential between the cylinder and intake. But then they cannot take advantage of optimum swirling of the fuel-air mixture created by the pressure difference between intake tube and cylinder interior as it is not yet great enough at the position between TDC and BDC.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

The invention will be explained below with reference to the figure. The figure shows (schematically) an arrangement to operate a gas-exchange valve. Item (10) denotes the interior of a cylinder with a gasoline-air mixture introduced via an intake channel (12). A valve head (14) of an inlet valve opens up the inlet channel (12) when lifted from its seat, so that the mixture can enter into the cylinder (10). The valve head (14) of the inlet valve is moved via a valve shaft (16), which is connected to an anchor plate (18). The anchor plate (18) touches the poles of an electromagnet (20) when the valve is in the closed position; in the open position of the valve, it touches the poles of an electromagnet (22). The electromagnets (20) and (22) are located in a housing (24). This housing (24) also has a drilled hole or recess (26) which surrounds a part of the valve shaft (16) and which contains springs (28) and (30). The spring (28) braces against one end of the recess (26) and tensions the anchor plate (18) from the closed position of the valve the direction of motion toward the opening position. The spring (30) on the other side of the anchor plate likewise contacts the other end of the recess and tensions the anchor plate (18) of the valve from the opening position the direction of motion toward the closed position. In the closed position, the electromagnet (20) is excited, while the spring (28) tensions the armature plate in the direction away from the electromagnet (20), e.g. opposite to the attractive force of the electromagnet. The force exerted by the spring (28) is smaller than the retention force of the electromagnet (20). Once the electromagnet (20) is shut off, the anchor plate (18) is pushed away by the spring (28) and the valve moves into its open position. Now if the electromagnet (22) is excited, the anchor plate (18) is attracted upon its approach to the electromagnet (22) and captured by it; the spring (30) is then tensioned and the spring (28) is relaxed.

The invention provides that this movement from the closed position into the open position is not accompanied by triggering the electromagnet (22) at low load conditions, i.e. up to about 20–25% of full throttle. Thus, after relaxation of the spring (28) and after compressing the spring (30), the spring (30) immediately reverses the direction of motion of the anchor plate and presses the anchor plate (18) back to near the electromagnets (20), so that the system performs one single oscillation. The electromagnet (20) has in the meantime been excited again, so that with this approach of the anchor plate (18) to the electromagnet (20), the valve closes again. The valve head (14) has thus lifted only a little from its seat and then moves back into its closed position, so that a fuel-air mixture can enter the interior of the cylinder (10) only for a very short time.

In this manner, the timepoint of greatest pressure difference between the ambient pressure in the intake tube and the cylinder interior (10) can be utilized--namely, the timepoint at or directly after reaching BDC. Entry of the fuel-air mixture at this time ensures an optimum swirling in the combustion chamber, so that the energy content of fuel-air mixture is fully utilized, and at the same time the exhaust parameters are favorably affected. The better swirling, more complete mixing of the fuel/air mixture permits use of a leaner mixture and results in better ignition and in-cylinder burning characteristics. Combustion of leaner mixtures results in reduced CO and $NO_x$ emissions. Leaner mixtures also mean better (less) fuel consumption and less exhaust gases. Less CO and $NO_x$ means the exhaust catalyst mixture can concentrate on use of a cheaper, more-reliable oxidation catalyst to remove (oxidize) unburned/partially burned hydrocarbons. By the method of this invention at low loads (up to about 20–25% of full throttle) the fuel consumption is reduced approximately 20%, and the exhaust gases, CO and $NO_x$ are reduced.

It should be understood that various modifications within the scope of this invention can be made by one of ordinary skill in the art without departing from the spirit thereof. I therefore wish my invention to be defined by the scope of tee appended claims as broadly as the prior art will permit, and in view of the specification if need be.

I claim:

1. Method for operation of an inlet valve of an internal combustion engine having an electromagnetically activated inlet valve assembly comprising a valve spring system in association with an inlet valve anchor plate, at least one electromagnet for capturing and holding said inlet valve anchor plate in the closed position, and having a cycle of operation which includes as part thereof a top dead center (TDC) position of a piston related to said valve and a bottom dead center (BDC) position of said piston, said TDC position being defined as earlier in said cycle as compared to said BDC position, said method comprising in operative combination the step(s) of:

(a) controlling the duration of said closed position electromagnet energization and de-engerization to permit said valve to only partially open during low load conditions; and (b) controlling the timing of said electromagnet energization and de-engergization to permit the point of commencing the opening of said valve slightly after BDC so that substantially maximum swirling of inlet fuel/air mixture occurs permitting use of leaner mixtures and resulting in reduced CO and $NO_x$.

2. Method as in claim 1 wherein said low load condition is below about 25% of full throttle of said engine.

3. Method as in claim 1 wherein said opening point is controlled to be earlier in said cycle as the load increases.

4. Method as in claim 1 wherein said control steps comprise:

(a) de-energization of said closed position electromagnet to initiate commencement of the opening of said inlet valve;

(b) maintaining said closed electromagnet in a de-energized state for a period of time of less than one-half the cycle of TDC to TDC;

(c) re-energizing said closed position magnet before said valve reaches its fully open position, and (d) recapturing said inlet valve anchor plate by said closed position electromagnet in less than said one-half cycle.

5. Method as in claim 4 wherein said deenergization of said electromagnet is controlled to permit the point of commencing the opening of said valve around said BDC position.

6. Method as in claim 5 wherein said valve commences opening slightly after BDC so that substantially maximum swirling of inlet fuel/air mixture occurs permitting use of leaner mixtures and resulting in reduced CO and $NO_x$.

7. Method as in claim 5 wherein said low load condition is below about 25% of full throttle of said engine.

8. Method as in claim 7 wherein said opening point is controlled to be earlier in said cycle as the load increases.

9. Method as in claim 1 wherein said engine includes at least one electromagnet for capturing and holding said inlet valve anchor plate in an open position, and said controlling steps comprise:

(a) intermittently energizing and de-energizing said closed electromagnet; and (b) maintaining said open position electromagnet in a state either energization or de-energization that does not permit capture and holding of said anchor plate in said open valve position.

10. Method as in claim 9 wherein said de-energization of said closed position electromagnet is controlled to permit the point of commencing the opening of said valve around said BDC position.

11. Method as in claim 10 wherein said valve commences opening slightly after BDC so that substantially maximum swirling of inlet fuel/air mixture occurs permitting use of leaner mixtures and resulting in reduced CO and $NO_x$.

12. Method as in claim 11 wherein said low load condition is below about 25% of full throttle of said engine.

13. Method as in claim 12 wherein said opening point is controlled to be earlier in said cycle as the load increases.

14. Method of operating an internal combustion engine at low load conditions of less than about 25% of full throttle, said engine having an electromagnetically controlled inlet valve system comprising at least one pair of opposed valve springs biasing an anchor plate associated with an inlet valve to a midpoint position between a closed position and an open position, and at least one pair of opposed electromagnets for capturing and holding said anchor plate when energized, said electromagnets pairs comprising a valve-open position electromagnet and a valve-closed position electromagnet, said engine having a cycle of operation which includes as part thereof a top dead center (TDC) position of a piston related to said valve and a bottom dead center (BDC) position of said piston, said TDC position being defined as earlier in said cycle as compared to said BDC position, said method comprising in operative sequence the steps of:

(a) controlling the energized/de-energized state of said closed position electromagnet to permit said inlet valve to commence opening at approximately the point in the cycle of said engine at which maximum differential in pressure between the inlet side of said valve and interior of said cylinder develops;

(b) maintaining the open position electromagnet in an energized or de-energized state so that said anchor plate cannot be captured and held in the open position;

(c) permitting said spring system to move said anchor plate to a partially open position; and (d) recapturing said anchor plate at said closed position after less than said one-half cycle between BDC and TDC.

15. Method as in claim 14 wherein said valve commences opening slightly after BDC so that substantially maximum swirling of inlet fuel/air mixture occurs permitting use of leaner mixtures and resulting in reduced CO and $NO_x$.

16. Method as in claim 15 wherein said opening point is controlled to be earlier in said cycle as the load increases.

17. Method for reducing fuel consumption and pollution in an I.C. engine comprising in operative sequence the steps of:

(a) controlling the inlet valve to only partially open at low load conditions of less than about 25% full throttle;

(b) commencing the opening of said inlet valve slightly after BDC of a piston associated with said valve so that opening occurs during development of substantially maximum pressure differential in the cylinder as compared to the inlet side of said inlet valve;

(c) feeding into said cylinder a fuel/air mixture that is leaner as compared to similar engines not employing these steps;

(d) said maximum pressure differential promoting swirling to improve complete mixing of said fuel/air mixture and result in better burning characteristics accompanied by production of reduced amounts of CO and $NO_x$ and an increase in fuel efficiency of approximately 20% at said low load conditions.

18. Method as in claim 17 wherein:

(a) said step of commencing the opening is controlled to be initiated earlier in the engine cycle between TDC and BDC as the load increase; and (b) said inlet valve is controlled to fully open at loads greater than low load.

19. In an IC engine having an inlet valve assembly comprising at least one electromagnetically actuated pair of opposed electromagnets including a closed and an open position electromagnet, an inlet valve having an anchor plate disposed in relation to said electromagnets to be alternately captured thereby, and at least one pair of opposed springs, one of each of said pair being disposed on each side of said anchor plate, the method of operation during low load conditions comprising in operating sequence the step of:

(a) maintaining said open position electromagnet in a state of energization or de-energization such that it cannot capture and hold said anchor plate in an open valve position.

* * * * *